US009045198B2

(12) United States Patent
Philips

(10) Patent No.: US 9,045,198 B2
(45) Date of Patent: Jun. 2, 2015

(54) BOAT LINE MANAGEMENT

(71) Applicant: Christopher Philips, Michigan City, IN (US)

(72) Inventor: Christopher Philips, Michigan City, IN (US)

( * ) Notice: Subject to any disclaimer, the term of this patent is extended or adjusted under 35 U.S.C. 154(b) by 199 days.

(21) Appl. No.: 13/679,980

(22) Filed: Nov. 16, 2012

(65) Prior Publication Data

US 2013/0333607 A1 Dec. 19, 2013

Related U.S. Application Data

(60) Provisional application No. 61/660,896, filed on Jun. 18, 2012.

(51) Int. Cl.

| | |
|---|---|
| ***B63B 21/00*** | (2006.01) |
| ***E02B 3/24*** | (2006.01) |
| ***B63B 21/04*** | (2006.01) |
| ***E02B 3/20*** | (2006.01) |

(52) U.S. Cl.

CPC ..... *B63B 21/04* (2013.01); *B63B 21/00* (2013.01); *E02B 3/20* (2013.01)

(58) Field of Classification Search

CPC ..... B63B 21/00; B63B 21/04; E02B 3/20

USPC ..... 114/230.1, 230.11, 230.15–230.19

See application file for complete search history.

(56) References Cited

U.S. PATENT DOCUMENTS

| | | | | |
|---|---|---|---|---|
| 3,861,346 | A * | 1/1975 | Pina | 114/230.25 |
| 3,945,335 | A * | 3/1976 | Kratz | 114/221 R |
| 4,706,594 | A * | 11/1987 | Burns | 114/230.29 |
| 4,846,090 | A | 7/1989 | Palmquist | |
| 5,116,260 | A * | 5/1992 | Upchurch | 114/221 R |
| 5,819,679 | A | 10/1998 | Bonate et al. | |
| 6,123,045 | A | 9/2000 | Prongay | |
| 6,273,016 | B1 * | 8/2001 | Gibbs | 114/230.1 |
| 6,422,169 | B1 | 7/2002 | Schwantes | |
| 2004/0194685 | A1 | 10/2004 | Slater | |

FOREIGN PATENT DOCUMENTS

| | | |
|---|---|---|
| WO | WO 91/14615 | 10/1991 |

* cited by examiner

*Primary Examiner* — Daniel V Venne

(57) ABSTRACT

A boat line management device is disclosed. The device having a chamber, a revolving element, an arm, and a spring. The boat line management device capable of delivering a boat line from a position on a boat to a boat docking location. The boat line management device also capable of returning to a resting position upon release of a force on the arm.

2 Claims, 13 Drawing Sheets

BOAT LINE MANAGEMENT

RELATED APPLICATIONS

The present patent document claims the benefit of the filing date under 35 U.S.C. §119(e) of Provisional U.S. Patent Application Ser. No. 61/660,896, filed Jun. 18, 2012, which is hereby incorporated by reference in its entirety.

BACKGROUND

Boating is a universally popular activity. Boats range from smaller one person models such as canoes and kayaks, to rowing boats, powerboats, sailboats, cruisers, racers, and so on. When not in use, a boat may be parked on the water at a dock. Boats are secured to docks by dock lines, a long rope or chain that connects to the boat at one end and connects to an object on the dock at the other end.

In many circumstances, docking a boat may require more than one person. For example, someone on board the boat jumps off the boat on to the dock to receive the line and wrap the line around a boat line-receiving object. Alternatively, someone may already be present on the dock to receive the line. In situations where docking a boat requires more than one person, boat owners may be limited to only using their boat when another person is available to assist them.

BRIEF SUMMARY

Methods and devices for delivering boat lines from a boat to a dock are disclosed. The devices include a revolving element, an arm, and a resilient element. The arm delivers the boat line from a location near a boat to a location near a dock by moving from a first position to a second position upon application of a force. The resilient element returns the arm back to a first position upon removal of the force.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

FIG. 3.B. provides an expanded view of a region of a chamber of a first dock line management device to illustrate a travelling surface.

DETAILED DESCRIPTION

Figure 1:
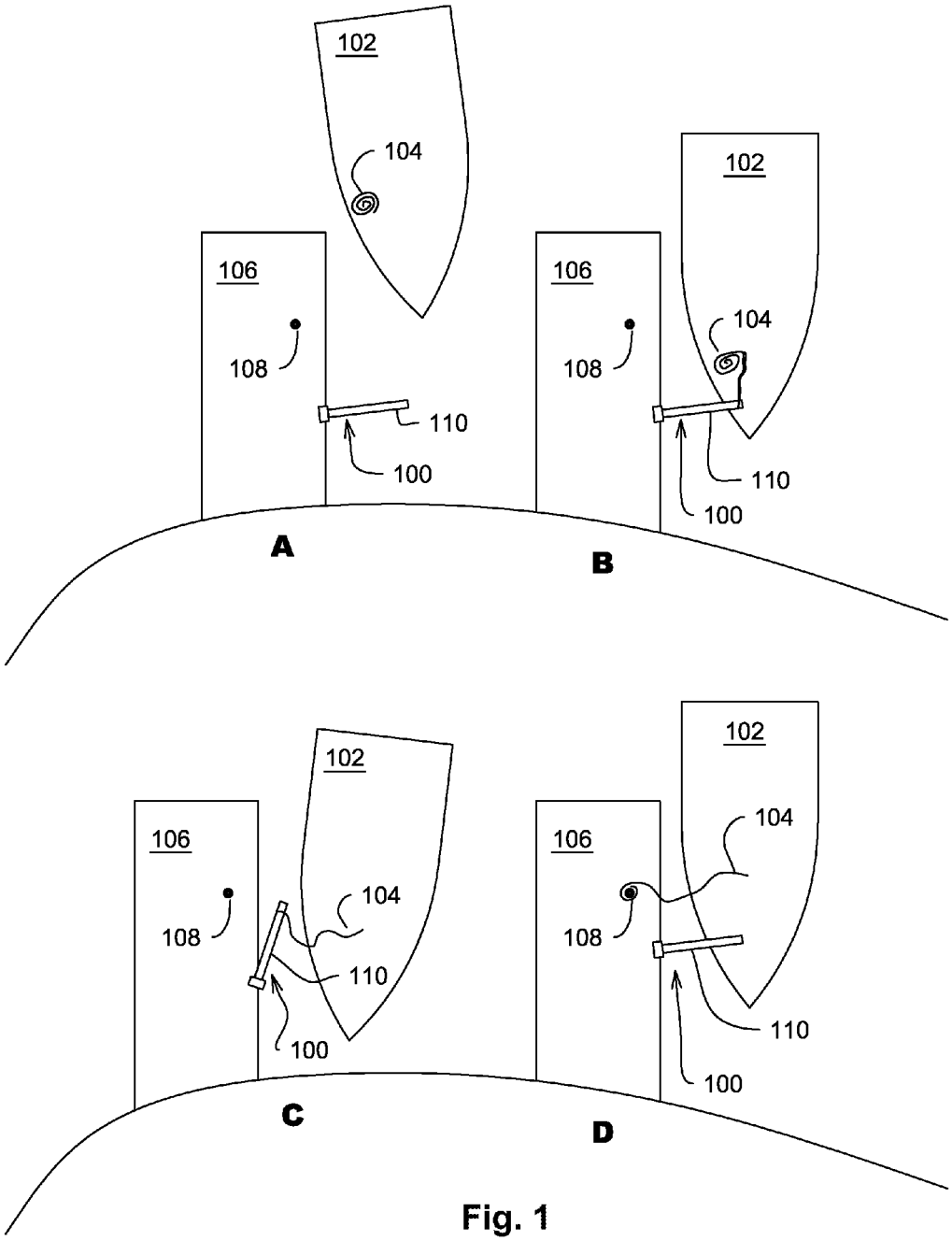
FIG. 1 provides a view of a dock line management device in an environment.

Boats are commonly used for both recreation and commerce. Between use, boats may be parked on the water by securing them to, for example, boat docks, platforms, posts, trees, rocks, and/or other items located on or near the water.

Traditionally, docking a boat requires at least two individuals, if not more. Using power boats as an example, docking a boat may typically involve at least a driver to maneuver the boat into a docking location, and one or more individuals to manage securing the boat to the docking location, e.g., by attaching a boat line to a boat line securing device located on the docking location. Even if more than one individual is present on the boat, the current practice of an individual either having to exit the boat (often by jumping) and/or, having to use an extension device to attempt to reach a dock cleat, and/or having to attempt to throw or lasso a boat line onto a dock and/or dock cleat presents certain dangers and inefficiencies. We disclose a boat line management device having the ability to facilitate efficient transfer of the boat line to the docking location. The disclosed boat line management device has the advantage of both permitting safe, efficient transfer of the boat line, but it is also capable of efficient use by a lone boat operator.

A boat line management device is disclosed. The boat line management device may further facilitate delivering a dock line from a location on a boat to a location on a docking surface. Additionally or alternatively, the boat line management device may removably secure a boat to a docking location. The boat line management device may also facilitate delivering a dock line from a location on a dock to a location on a boat.

The boat line management device may include at least one arm. The arm may have a length. The length may begin at a point on or near the docking location, travel out over the water, and terminate at a location reachable by an individual stationed on a boat. In one variation, the boat line management device may be positioned near a docking location, such as (but not limited to) on a boat dock, platforms, posts, trees, rocks, and/or other items located on or near the water.

The boat line management device may be positioned such that the arm of the device extends over the water, for example, approximately parallel to the surface of the water. In operation, a boat would maneuver into a location near an end of the arm of the boat line management device. Once in proximity of the boat line management device, an individual on the boat (which may be the driver) may deliver the boat line to an end of the arm of the boat line management device. Once delivered, an individual already located on the dock may remove and secure the dock line to, for example, a dock clean, by pulling the arm carrying the dock line circumferentially in to a location reachable from the dock. Alternatively or additionally, an individual from the boat may move to the docking location to retrieve the line by pulling the arm carrying the dock line in to a location reachable from the dock. In another variation, the arm may be electronically activated, e.g., by remote control, to pull the line into the dock.

Since the boat line management device extends out a distance from the dock, it may not be necessary for a boat entering the docking location to accomplish the fine maneuvering required to put the boat into a jumping or throwing proximity of the dock (e.g., the safe distance for an individual to jump from the boat to the dock). Use of the boat line management device, by delivering the line to the dock, may extend the life of the dock and boat hulls by reducing the incidence of boats crashing into the dock during failed maneuvers.

FIG. 1 illustrates one variation of how a boat line management device, which, for simplicity, we refer to as a line catch 100, may be secured to a dock 106 and oriented relative to a boat 102. The line catch 100 may have an arm 110, which may extend out from a dock 106. The arm 110 may extend out such that an individual located on the boat 102 can easily access the arm 110. As shown in FIG. 1, boats typically have a dock line 104.

FIG. 1A illustrates a boat 102 is in range of a docking location, in this case, a dock 106. FIG. 1B illustrates a boat 102 located near an arm 110 of a line catch 100. In FIG. 1B, the boat line 104 has been delivered to the arm 110 of the line catch 100. In FIG. 1C, the arm 110 of the line catch 100 is delivering the boat line 104 to a location reachable by an individual on a dock 106. In FIG. 1D, the boat line 104 has been delivered to the dock 106 and is secured to a dock side securing device 108. The arm 110 of the line catch 100 has returned to an original position, extending over the water.

Figure 2:
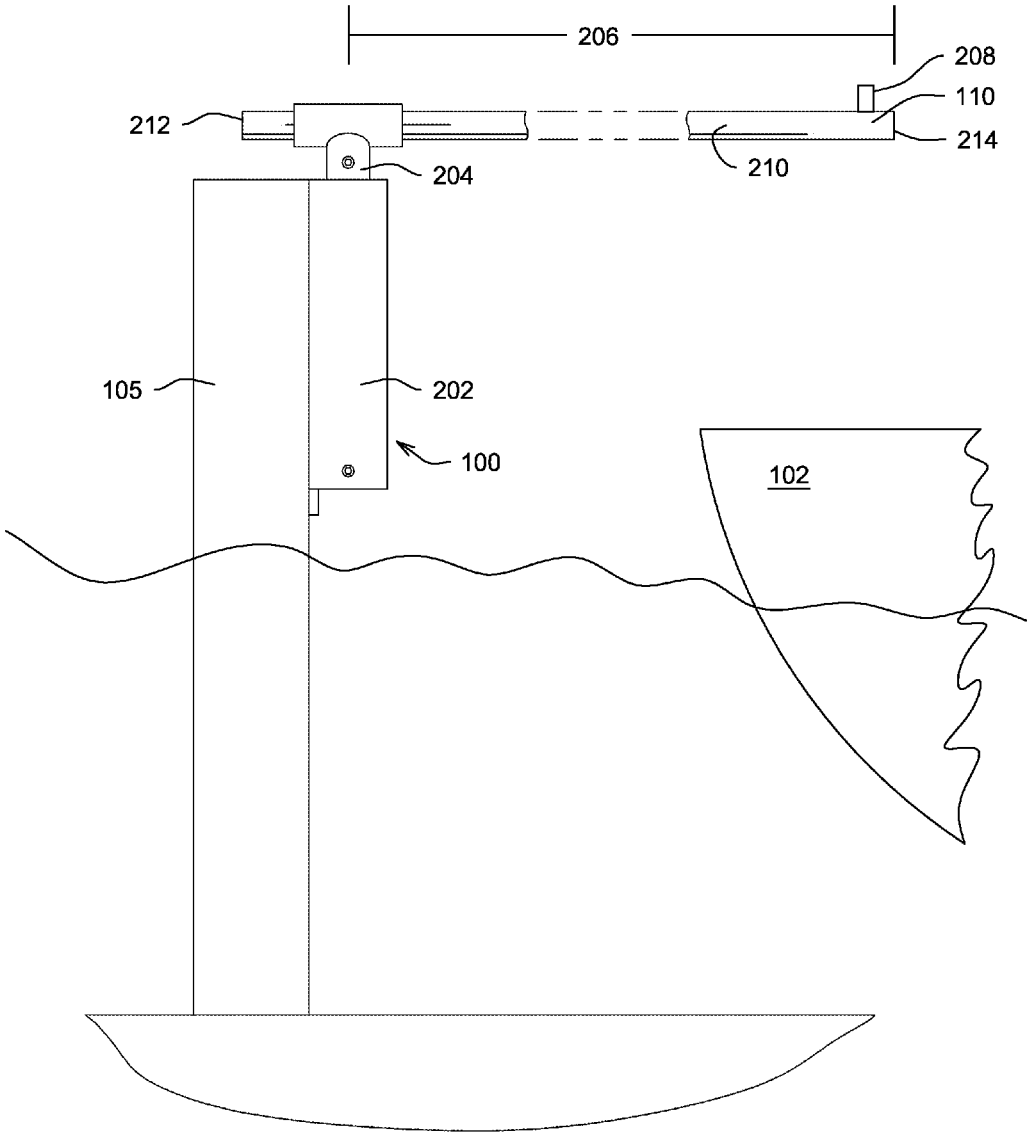
FIG. 2 provides a side view of a first dock line management device assembled in a docking location.

FIG. 2 illustrates a variation of a line catch 100 attached to a segment of a dock 105. The line catch 100 may be mounted anywhere on a dock, a slip, or other surface accessible to a boat 102. For example, the line catch 100 may be mounted to a top side, a vertical surface, a horizontal surface, or any other surface. Alternatively or additionally, the line catch 100 may be attached to or continuous with a pole or beam connected directly into the ground, for example but not limited to, a lake bottom.

In this variation, the line catch 100 may comprise a housing 202, a head 204, and an arm 110. The housing 202 may be an optional item and may not be required for proper operation of the line catch 100. In variations that comprise a housing 202, the housing 202 may serve a protective function. For example, the housing 202 may enclose portions of the line catch 100. The housing 202 may protect portions of the line catch 100 from the elements. Alternatively or additionally, the housing 202 may be pervious to the elements. The housing may be configured to protect individuals and users from catching their fingers, hands, hair, etc., in the workings of the line catch 100. Alternatively or additionally, the housing 202 may provide an aesthetic surface.

In this exemplary variation, the head 204 is illustrated as a T-connector. The head 204 may comprise a through channel FIG. 3, 330 and a branch channel FIG. 3, 332. The through channel 330 may be dimensioned to receive an arm 110. The branch channel 332 may be dimensioned to receive a revolving element FIG. 3, 304. The arm 110 may be dimensioned to extend out of the head 204 a distance 206. The distance 206 may any distance that allows the arm 110 to be reached by an individual located on a boat 102. The distance 206 may be varied and may depend upon the type of dock 106, the type of boat 102, and other factors, such as the weather conditions or boating conventions in the area.

The arm 110 may comprise an elongated shaft 210 comprising a first end region 212 and a second end region 214. The arm 110 may comprise a line securing element 208. For example, the second end region 214 of the arm 110 may comprise a line securing element 208. The line securing element 208 may be a peg, a hook, a pin, a latch, a divot, a ring, a bulge, or otherwise. For example, the line securing element 208 may be any element that can accept a portion of a boat line 104. The line securing element 208 may additionally or alternatively be an element that can secure the boat line 104 to the arm 110 sufficiently to maintain the boat line 104 while the arm 110 travels, e.g., to deliver the boat line 104 to a position relative to the dock 106 that is reachable by an individual located on the dock 106.

The arm 110 may comprise a continuous rod-like structure of a predetermined length. Alternatively or additionally, the arm 110 may comprise a telescoping rod, for example, a rod that extends and/or retracts e.g., manually, mechanically, automatically after receiving a signal, or otherwise.

In a general example, a line catch 100 may be assembled with a dock 106. A boat operator might steer a boat 102 into a docking location relative to a dock 106 and a line catch 100. As the boat 102 enters docking position, an individual located on the boat 102 would reach the arm 110 of the line catch 100. The individual would place, toss, or otherwise deliver a portion of the boat line 104 onto the receiving portion of the line catch 100, which may be the securing element 208. Having delivered the boat line 104 to the receiving portion of the line catch 100, the individual (or another individual) could relocate to the dock 106. From the dock 106, an individual could retrieve the boat line 104 from the line catch 100, for example, by rotating the arm 110 into a position reachable from the dock 106. The individual may rotate the arm 110 manually, mechanically, or by actuating an automatic and/or electronic mechanism. By rotating the arm 110 in to proximity of the dock 106 the individual may access the boat line 104, e.g., for securing to a dock side securing device 108, which may be a bollard, deck cleat, or may even be a portion of the dock itself.

Figure 3:
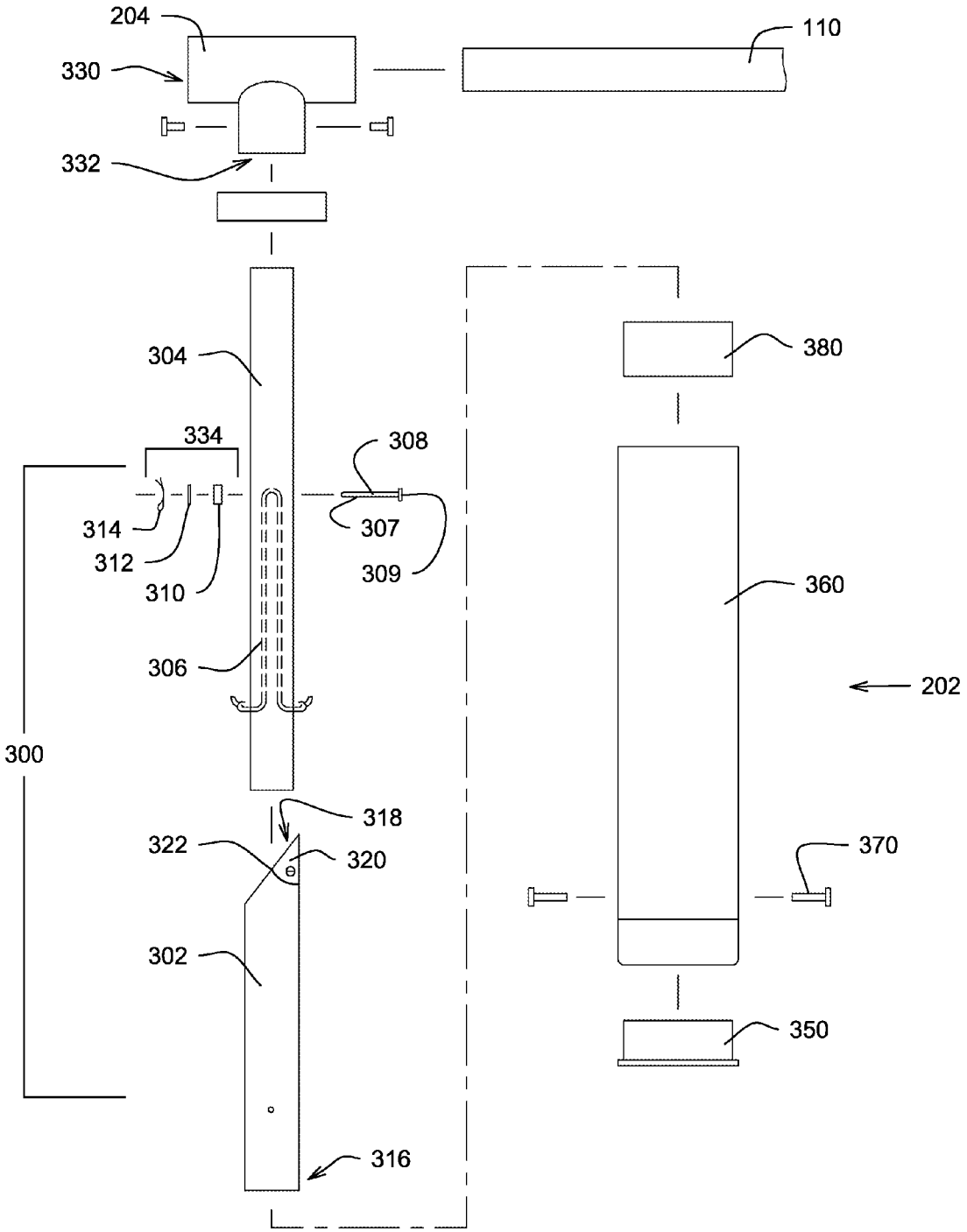
FIG. 3 provides a view of various exemplary elements of a first dock line management device.
Figure 3B:
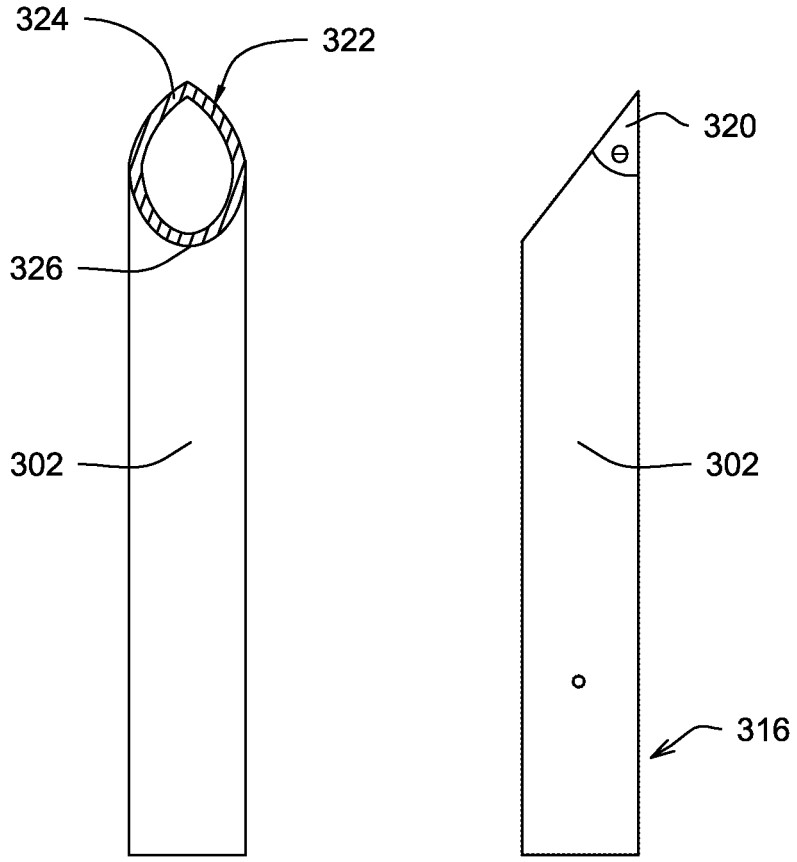

FIG. 3 provides one exemplary line catch 100 assembly. This variation is merely meant for illustrative purposes to show a basic concept for how a line catch assembly might be assembled to effectuate delivering a line receiving device to an individual located on a boat.

A line catch 100 may comprise a rotation assembly 300 and an arm 110. The rotation assembly 300 may be operatively connected to the arm 110. In this variation, the rotation assembly 300 may be connected to the arm 110 through the through channel 330 of a head region 204. Alternatively or additionally, the rotational assembly 300 may be directly connected to the arm 110, or connected in any manner of ways known in the art that would accomplish the function of translating the rotation of the rotation assembly 300 to the arm 110 such that the arm 110 rotates from a first position (which may be a position reachable from a boat 102) to a second position (which may be a position reachable from a dock 106) or vice versa.

The rotation assembly 300 may comprise a chamber 302 and a revolving element 304. The chamber 302 may be dimensioned to receive the revolving element 304. The revolving element 304 may be dimensioned to nest within an opening in the chamber 302. When assembled, the revolving element 304 may insert into the chamber 302. The revolving element 304 may be rotatable within the chamber 302. For example, when assembled within the chamber 302, the chamber 302 may be stationary and the revolving element 304 may be capable of rotation within the chamber 302, for example but not limited to circumferential rotation.

The rotation assembly 300 may further comprise an arm 110. The arm 110 may be operatively connected to the rotation assembly 300 such that when the revolving element 304 rotates within and/or relative to the chamber 302, the arm 110 also rotates. Rotation of the revolving element 304 within and/or relative to the chamber 302 of the rotation assembly 300 may be actuated by a force acting on a region of the arm 110. For example, an individual may apply force to the arm 110 causing the revolving element 304 of the rotation assembly 300 to rotate, e.g., circumferentially. Additionally or alternatively, a force acting on a region of the arm 110 may be the force of a boat 102 (e.g., a portion of the boat may hit against the arm 110), an animal, an object on the dock such as a bicycle or otherwise. The arm 110 may, upon removal of the force, have the further ability to return to an original resting position.

In a further variation, the rotation assembly 300 may comprise a chamber 302 and a revolving element 304. The chamber 302 may for example but not limited to, a first shaft having a recess formed therein for receiving the revolving element 304. The revolving element 304 may be a second shaft, e.g., a second shaft dimensioned to fit inside a recess of the first shaft. While both the chamber 302 and the revolving elements 304 are shown as cylindrical, many shapes may effectuate the function including square shafts, triangular shafts, and other shapes. In one example, the chamber 302 and the revolving element 304 may be, for example but not limited to, tubes or pipes. The tubes or pipes may be made of PVC, stainless steel, metal alloys, synthetic composite materials, natural composite materials, bamboo, and similar materials.

The chamber 302, which in this example may be a tube or pipe, may be dimensioned to receive the revolving element 304, which may also be a tube or pipe. The revolving element 304 may be dimensioned to nest within a recess in the chamber 302. When assembled, the revolving element 304 may insert into the chamber 302. The revolving element 304 may be rotatable within the chamber 302. For example, the chamber 302 may be a stationary first shaft, and the revolving element 304 may be a second shaft capable of rotation within the chamber 302, for example but not limited to circumferential rotation.

A line catch 100 may be assembled with a dock 106, (e.g., see FIG. 1). The line catch may include an arm 110. The arm 110 of the line catch 100 may have a resting position. The resting position of the arm 110 may be for example but not limited to a position that is approximately parallel to the orientation of the water. In this example, a boat 102 may enter the area around the dock 106 and may, e.g., by hitting against the arm 110, apply a force on the arm 110. Applying a force on the arm 110 may cause the arm 110 to move, e.g., rotate, out of its resting position. When the force is removed, e.g., when a boat 102 is no longer engaging the arm 110, the arm 110 may automatically return to its resting position, e.g., parallel to the orientation of the water. The following description provides one exemplary method for accomplishing rotation and return of the arm 110 of the line catch 100.

The rotation assembly 300 may comprise at least one shaft, for example, the rotation assembly may comprise a first shaft and a second shaft. In one example, the chamber 302 may be the first shaft, which may be stationary and the revolving element 304, may be the second shaft, and may be movable within the chamber 302. For example, the second shaft may rotate within the first shaft.

The chamber 302, in this example the first shaft may have a first end 316 and a second end 318. The second end 318 of the chamber 302 terminates at an end of a travelling surface 322 formed at an angle with a plane extending parallel to a longitudinal axis of the chamber 302. A rotated view of the travelling surface 322 is shown as FIG. 3.B. In this view, one case see that the travelling surface 322 is angled up to reach a highest point 324 and down to create a lowest point 326.

The rotation assembly 300 may include a resilient element 306, which may be a spring. In this case, the resilient element 306 may include but not limited to any device that may be used to store and furnish energy, absorb shock, sustain pressure between to or more points, and to resist tensional or compressional stress, such as springs. Springs may be made of an appropriate materials, e.g., specially formulated steel alloys, rubber, plastics, resin, steel and otherwise. A spring may include but is not limited to, BUNGEE CORDS, rubber bands, springs (e.g., helical springs, coil springs, torsion springs, tension springs, leaf springs, disc springs, non-coil springs, compression springs, and etc.), elastic devices, or elasticized materials such as elasticized ropes, cloth, and etc.

In this example, the resilient element 306 is illustrated as a BUNGEE CORD, however, it will be understood by one of skill in the art that the BUNGEE CORD may be replaced by any item (e.g., those discussed above) to achieve the result described herein. In one variation, the revolving element 304 may have an inner opening, and the resilient element 306 may be located on the inside of the revolving element 304. The resilient element 306 may be attached inside the revolving element 304 by being passed over a pin 308. The pin 308 may pass through a diameter of the revolving element 304 and may emerge on the outside of the revolving element 304. The pin 308 may engage with a cotter pin 314, which may secure the pin 308 in its location. While a cotter pin 314 is disclosed, the pin 308 may be secured in its location by any means known in the art.

The pin 308 may include a head 309 and a body 307. The head 309 of the pin 308 may be inserted into a wall of the revolving element 304 such that it is flush with the wall of the revolving element 304. When arranged such that the head 309 of the pin 308 is flush with the wall of the revolving element 304, it may prevent the head 309 of the pin 308 from obstructing the movement of the revolving element 304 within the chamber 302. Other means for reducing the obstruction of the head 309 of the pin 308 may also be used, including but not limited to, arranging and/or securing the pin 308 only on the inside of the revolving element 304. A resilient element may effectuate function also from other locations, e.g., by being secured to locations on the outside of both the chamber 302 and the revolving element 304.

The rotation assembly 300 may be associated with a housing 202. In one variation, the housing may include a main body 360. The main body 360 is shown as a rectangular box. However, the main body 360 may be of any shape. The main body 360 may be dimensioned to enclose all or part of the rotation assembly 300. The housing may include an end cap 350, which may be dimensioned to provide structure to the housing 202. Additionally or alternatively, the end cap 350 may provide stability for the rotation assembly 300. The end cap 350 may be secured to the housing 202 with securing devices 370, for example but not limited to screws, pins, nails, or otherwise. The housing may include a top brace 380. The top brace 380 may fit inside the main body 360.

A rotated view of the travelling surface 322 is shown as FIG. 3.B. In this view, one can see the travelling surface 322 is angled up to reach a highest point 324 and down to create a lowest point 326. The angle 320 may be an angle of 1°-90°, 2°-50°, 5°-89°, 5°-40°, 10°-60°, 10°-80°, 10°-70°, 10°-60°, 10°-50°, 10°-40°, 10°-35°, 15°-60°, 15°-80°, 15°-70°, 15°-60°, 15°-50°, 15°-40°, 15°-35°, 20°-60°, 20°-80°, 20°-70°, 20°-60°, 20°-50°, 20°-40°, 20°-35°, 30°-60°, 30°-80°, 30°-70°, 30°-60°, 30°-50°, 30°-40°, 30°-35° or any other angle between 1°-90°.

Figure 4:
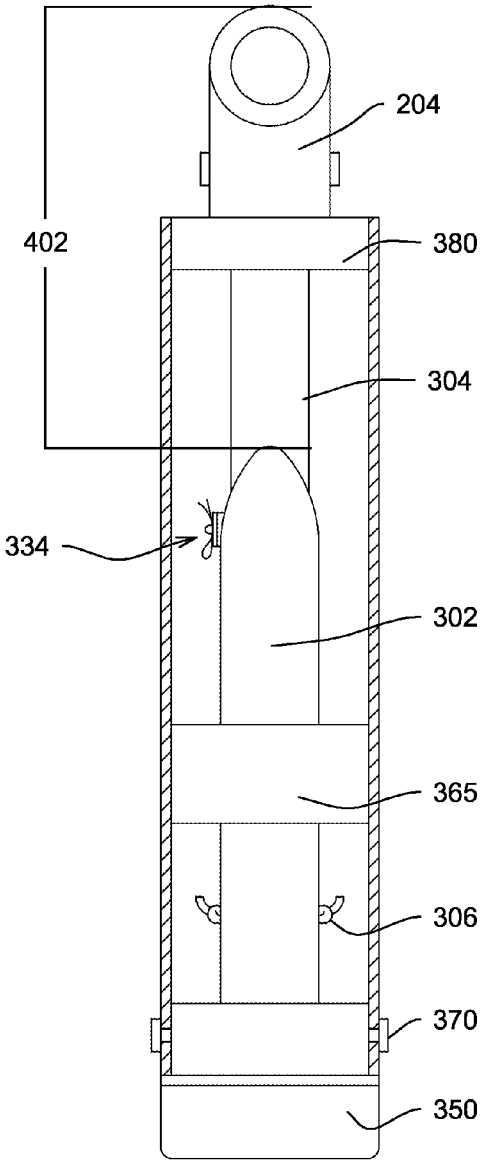
FIG. 4 provides a first side view of a first dock line management device.
Figure 5:
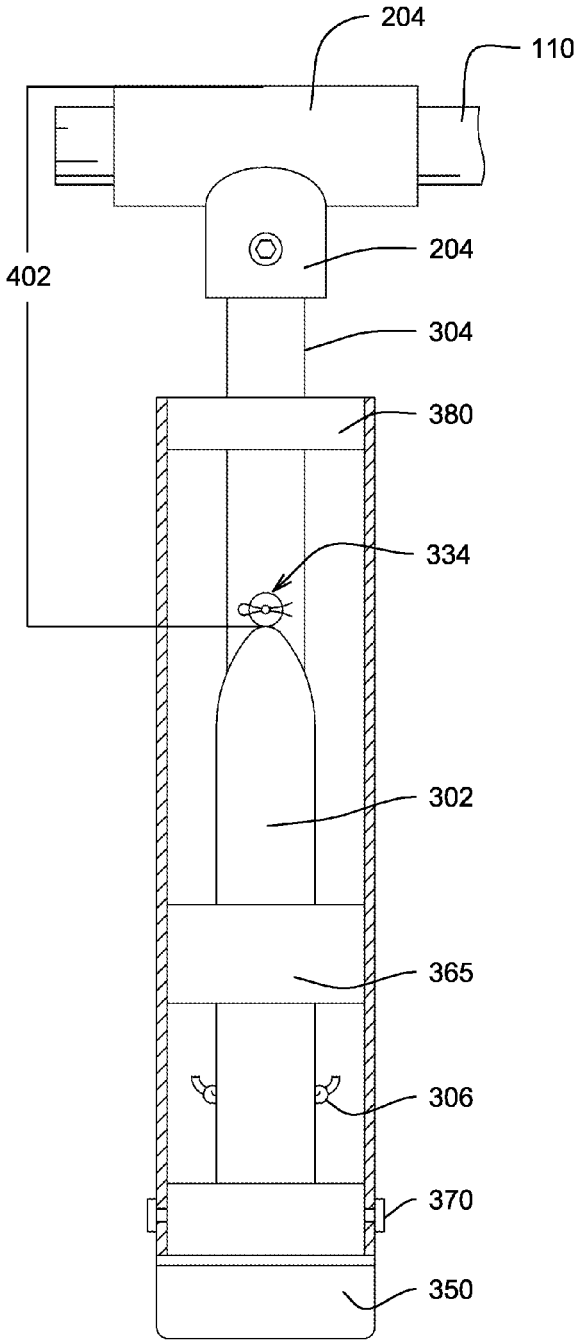
FIG. 5 provides a second side view of a first dock line management device.

Turning now to FIG. 4 and FIG. 5, we see one example of how the rotation assembly 300 may effectuate the automatic return of the arm 110. In this example, the rotation assembly 300 may further comprise a traveler 334. The traveler 334 may assist in effectuating the return of the arm 110 to a resting position. For example, the traveler 334 may be located on the surface of the revolving element 304. In resting position, the traveler 334 may be located at the lowest point 326 of the travelling surface 322. When a force is placed upon the arm 110, it may cause the revolving element 304 to turn relative to the chamber 302. As the revolving element 304 turns, the traveler 334 travels up the travelling surface 322 of the chamber 302 toward the highest point 324 of the travelling surface 322.

The movement of the traveler 334 up the travelling surface 322 of the chamber 302 may cause the revolving element 304 to rise out of the chamber 302 such that there is an increase in a distance 402, which distance 402 for explanatory purposes, is the distance from the highest point 324 of the travelling surface 322 to the arm 110. The actual measuring point of the arm 110 does not matter. The measurement in this FIGS. 4 and 5 merely illustrates the rising of the arm 110 away from the chamber 302 as the traveler 334 moves from the lowest point 326 of the traveling surface 322 to the highest point 324 of the traveling surface 322. FIG. 4 shows the traveler 334 at the lowest point 326 of the traveling surface 322 and the arm 110 in a first position. FIG. 5 shows the traveler 334 at the highest point 324 of the travelling surface 322 and the arm 110 in a second position. (The position of the arm is irrelevant here, what is relevant is the illustration of the arm moving. The position of the arm relative to the traveler 334 will vary depending on the orientation of the arm versus the revolving element 304.)

If the resilient element 306 is secured to the revolving element 304 at a static location, the increase of the distance 402 may translate to an extension of the resilient element 306 such that energy is stored in the resilient element 306 as the arm 110 turns and/or as the traveler 334 travels from the lowest point 326 of the travelling face toward the highest point 324 of the travelling face. When a force is removed from the arm 110, the resilient element 306 may release energy and return to a starting condition (a state of the resilient element 306) prior to the application of a force on the arm 110. As the resilient element 306 releases its energy, the traveler 334 may travel toward the lowest point 326 of the traveling surface 322, and the arm 110 may move back to a resting position. The assembly of the traveling surface 322 the traveler 334 and the resilient element 306 provides one exemplary method of controlling a resting location of the arm 110 relative to the dock 106. Other methods are also possible, including using mechanical means, including but not limited to, electronic controlled mechanical means. The present example provides a means that may be employed both manually or may be automated with electronics or otherwise.

The traveler 334 may be a device such as a pin, a bumper, a bolt, a protrusion, or otherwise. The traveler 334 may be assembled with the pin 308 (for example, utilizing the securing device for the pin) or may be otherwise located on the revolving element 304 to effectuate the function. Additionally or alternatively, the traveler 334 may comprise the assembly of a spacer 310, a washer 312, and a cotter pin 314.

FIGS. 4 and 5 also illustrate an optional brace 365 which may help resist tensional stress on the housing 202 during the operation of the rotation assembly 300. The brace 380 and a portion of the end cap 350 may also serve to resist tensional stress on the housing 202 during the operation of the rotation assembly 300.

Figure 6:
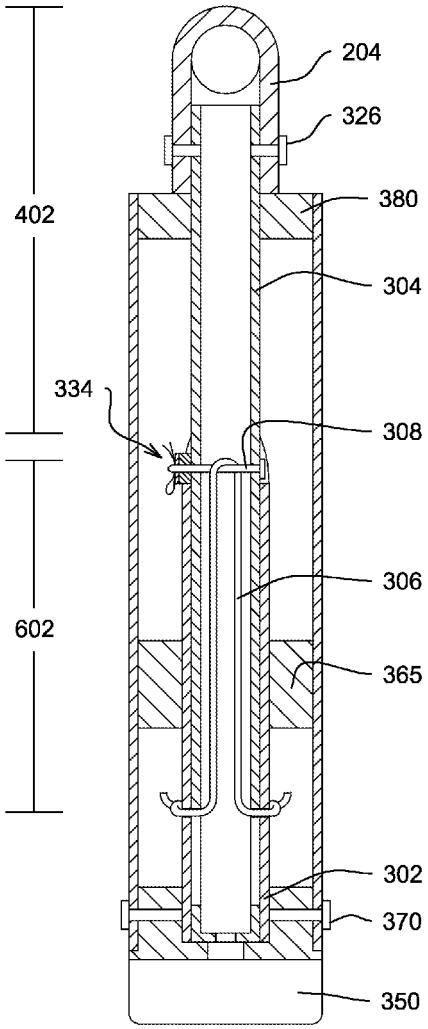
FIG. 6 provides a third side cross section view of a first dock line management device.
Figure 7:
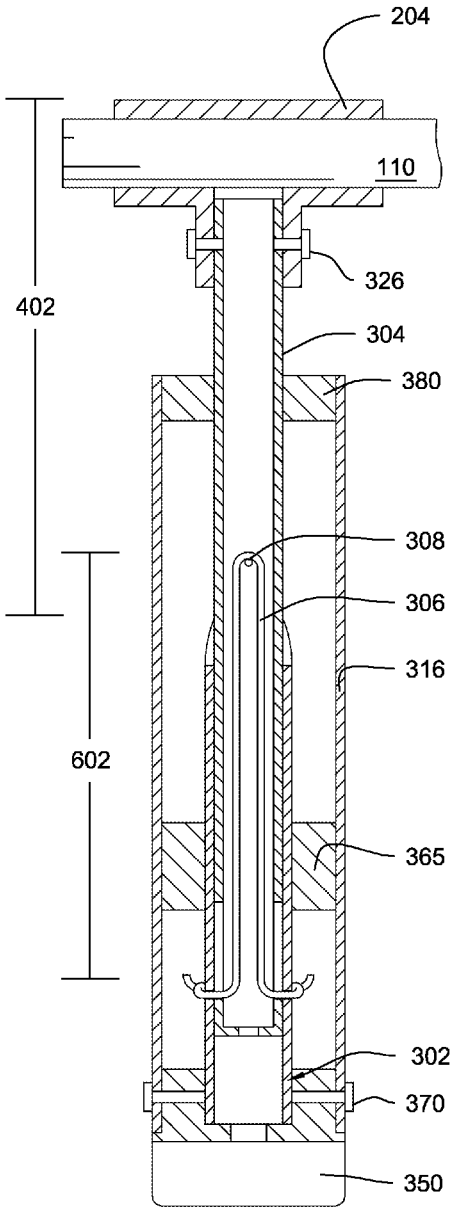
FIG. 7 provides a fourth side cross section view of a first dock line management device.

FIGS. 6 and 7 demonstrate one example of how a resilient element 306 may store energy by increasing its length 602 as the traveler 334 travels toward the highest point 324 of the travelling surface 322, increasing a distance 402. While a particular resilient element 306 formation is shown and illustrated, one of skill in the art would understand that the illustrated resilient element 306 may be replaced with other types of springs, including but not limited to, any device that may be used to store and furnish energy, absorb shock, sustain pressure between to or more points, and to resist tensional or compression stress. Springs may be made of any appropriate materials, e.g., specially formulated steel alloys, rubber, plastics, resin, steel and otherwise. A spring may include but is not limited to, BUNGEE CORDS, rubber bands, springs (e.g., helical springs, coil springs, torsion springs, tension springs, leaf springs, disc springs, non-coil springs, compression springs, and etc.), elastic devices, or elasticized materials such as elasticized ropes, and cloth.

Figure 8:
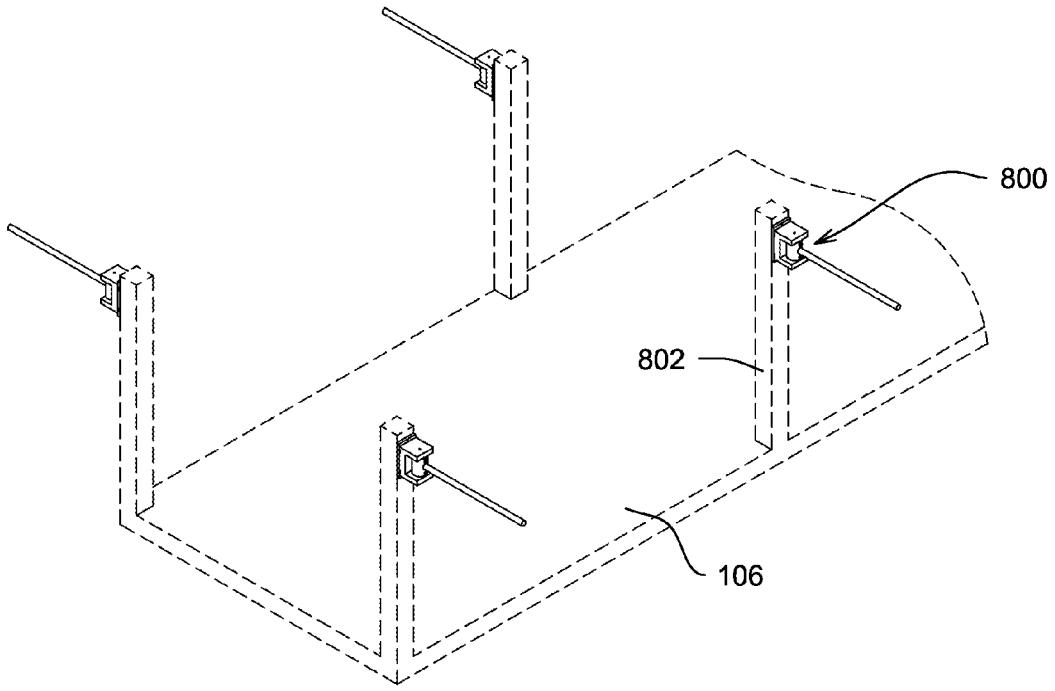
FIG. 8 provides a view of a second variation of a dock line management device in an environment.

FIG. 8 illustrates another variation of a boat line management system. For simplicity, we refer to this variation as a line arm 800. FIG. 8 illustrates the line arm 800 in the environment of an exemplary boat dock 106. In this case, the line arm 800 is assembled with a post 802 associated with a dock 106. The location of the line arm 800 on the post 802 may be varied depending on the environment and needs of the user. For example, the line arm 800 may be lower or higher on the post 802. It may be assembled above the dock 106 platform or below the dock 106 platform. As will be seen, the line arm 800 may also be assembled elsewhere on the dock 106, such as by drilling directly into a surface of the dock 106. Alternatively or additionally, this or any other variation may also be attached to other locations where a boat might dock, such as a tree, a boat (e.g., a smaller boat to a larger boat or vice versa), the wall of a water side cliff, or otherwise.

Figure 9:
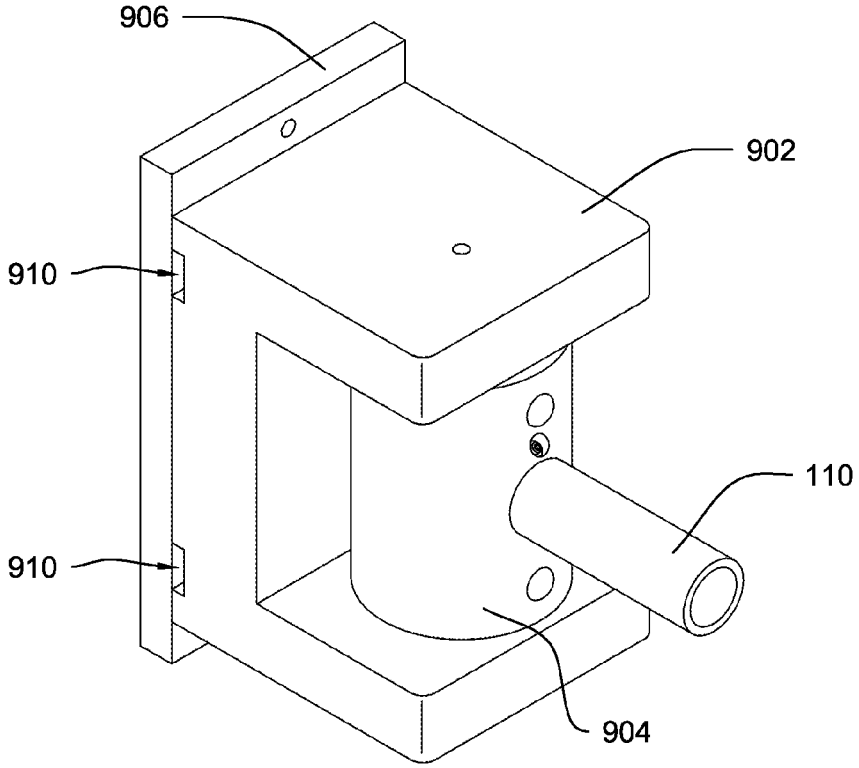
FIG. 9 provides a perspective view of a second variation of a dock line management device.

FIG. 9 provides a perspective view of one variation of a line arm 800. The line arm 800 may include a chamber 902 an arm 110, and a revolving element 904. The revolving element 904 may revolve relative to a chamber 902, which may be substantially stationary. The arm 110, may be assembled with the revolving element 904 such that movement of the revolving element 904 also moves the arm 110. The chamber 902 may optionally be assembled with a backboard 906, which may facilitate assembly of the line arm 800 to a dock 106 or other docking location. The backboard 906 may be a separately manufactured piece or may be continuous with the chamber 902. For example, the backboard 906 may include drill holes for bolts, or otherwise. The line arm 800 may optionally include slits 910. The slits 910 may be formed directly into the chamber 902. Alternatively or additionally, the slits 910 may be formed by the assembly of the backboard 906 to the chamber 902, or may be formed into an integral version including the backboard 906 and the chamber 902. The slits 910 may permit passage of securing devices for securing the line arm 800 to a docking position.

Figure 10:
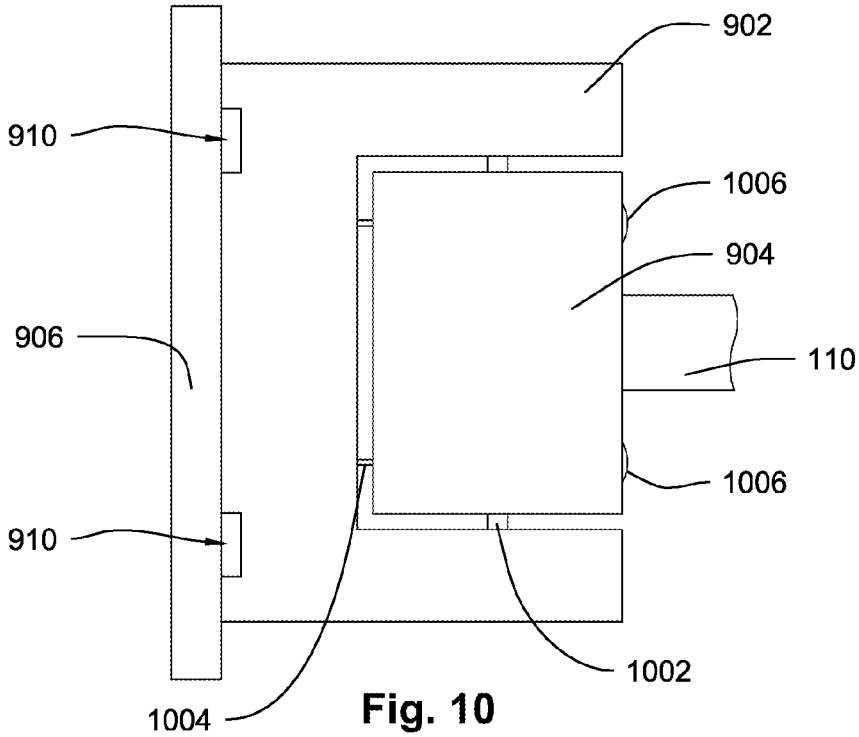
FIG. 10 provides a first side view of a second variation of a dock line management device.

FIG. 10 shows a side view of a variation of the line arm 800. In this view, a pin 1002 is visible. The pin 1002 may be a stainless pin which may pass through the revolving element 904 and also through the chamber 902. The revolving element 904 may revolve on the pin 1002 relative to the chamber 902. Alternatively or additionally, the pin 1002 may be discontinuous and may not pass all the way through the revolving element 904, for example, there may be a top pin 1002 and a bottom pin 1002, each secured both into the revolving element 904 and into the chamber 902. Alternatively or additionally, the pin may be cast as one piece with either the revolving element 904 or the chamber 902. The revolving element 904 may be adapted to the chamber 902 by means known in the art. The chamber 902 may be adapted to receive the revolving means 904 by methods known in the art.

The arm 110 may be integral with the revolving element 904 or may be a separate item that is assembled with the revolving element 904. The arm 110 may extend out a distance, for example, a distance necessary or desirable to permit access to the arm by an individual standing on a boat.

The line arm 800 assembly may include an arm 110. The arm 110 of the line arm 800 assembly may have a resting position. The resting position of the arm may be for example but not limited to a position that is approximately parallel to the orientation of the water and/or the dock 106. In this example, a boat FIG. 1, 102 may enter the area around the dock FIG. 1, 106 and may, e.g., by hitting against the arm 110, apply a force on the arm 110. Applying a force on the arm 110 may cause the arm 110 to move, e.g., rotate, out of its resting position. When the force is removed, e.g., when a boat 102 is no longer engaging the arm 110, the arm 110 may automatically return to its resting position, e.g., parallel to the orientation of the dock 106.

The following description provides one exemplary method for accomplishing rotation and return of the arm 110 of the line arm 800.

The line arm 800 assembly may further include one or more springs, shown in FIG. 10 as 1004. In this case, the resilient element 1004 includes any device that may be used to store and furnish energy, absorb shock, sustain pressure between to or more points, and to resist tensional or compressional stress. Springs may be made of an appropriate material, e.g., specially formulated steel alloys, rubber, plastics, resin, steel and otherwise. A spring may include but is not limited to, BUNGEE CORDS, rubber bands, springs (e.g., helical springs, coil springs, torsion springs, tension springs, leaf springs, disc springs, non-coil springs, compression springs, and etc.), elastic devices, or elasticized materials such as elasticized ropes, cloth, and etc.

In this example, two springs 1004 are illustrated, however, it will be understood by one of skill in the art that the more springs or fewer springs may be used to achieve the result described herein. In one variation, the revolving element 904 may have at least one opening through which the resilient element 1004 may pass. In this example, the resilient element 1004 may pass through the revolving element 904. In a shown variation, the resilient element 1004 may pass through a diameter of the revolving element 904 and may emerge and/or be attached by a cap 1006 of any nature known in the art. (Other examples are contemplated in which the springs 1004 pass over the revolving element 904 or are otherwise attached thereto.)

The following example demonstrates how, in this variation, the resilient element 1004 allows the arm 110 to return to its resting location. The arm 110 may have a resting position, which may be extending from a docking location and over the water, approximately parallel to the surface of the water. (E.g., see FIG. 8.) A boat may approach the docking location such that the arm 110 is reachable by a person located on the boat. The person located on the boat may attach a boat line to the arm 110, for example, on a securing device located on the arm 110 and easily reachable by the individual on the boat. The individual may then relocate to the dock. Once on the dock, the individual may apply a pulling or pushing force on the arm 110, rotating the arm 110 toward the dock. (The rotation is show as a circumferential horizontal rotation, but the line arm assembly 800 may be attached to the docking location such that the rotation is a circumferential vertical rotation.) Once the individual removes the boat line from the arm 110 (e.g., from a securing device on the arm 110), the individual may remove the pulling or pushing force on the arm (e.g., by releasing the arm). The arm may then automatically return to its original position, extended over the water.

Turning now to the action of the resilient element 1004 during use of the line arm 800 assembly. The resilient element 1004 may be secured to the revolving element 904 at a static location. As force is applied to the arm 110, there is revolving element 904 revolves in the direction of the force. The revolution of the revolving element 904 may translate to an extension of the resilient element 1004 such that energy is stored in the resilient element 1004 as the arm 110 turns. When a force is removed from the arm 110, the resilient element 1004 may release energy and return to a starting condition (a state of the resilient element 1004) prior to the application of a force on the arm 110. As the resilient element 306 releases its energy, the resilient element 1004 may contract, and the arm 110 may move back to a resting position. Other methods are also possible, including using mechanical means, including but not limited to, electronic controlled mechanical means. The present example provides a means that may be employed both manually or may be automated with electronics or otherwise.

Figure 11:
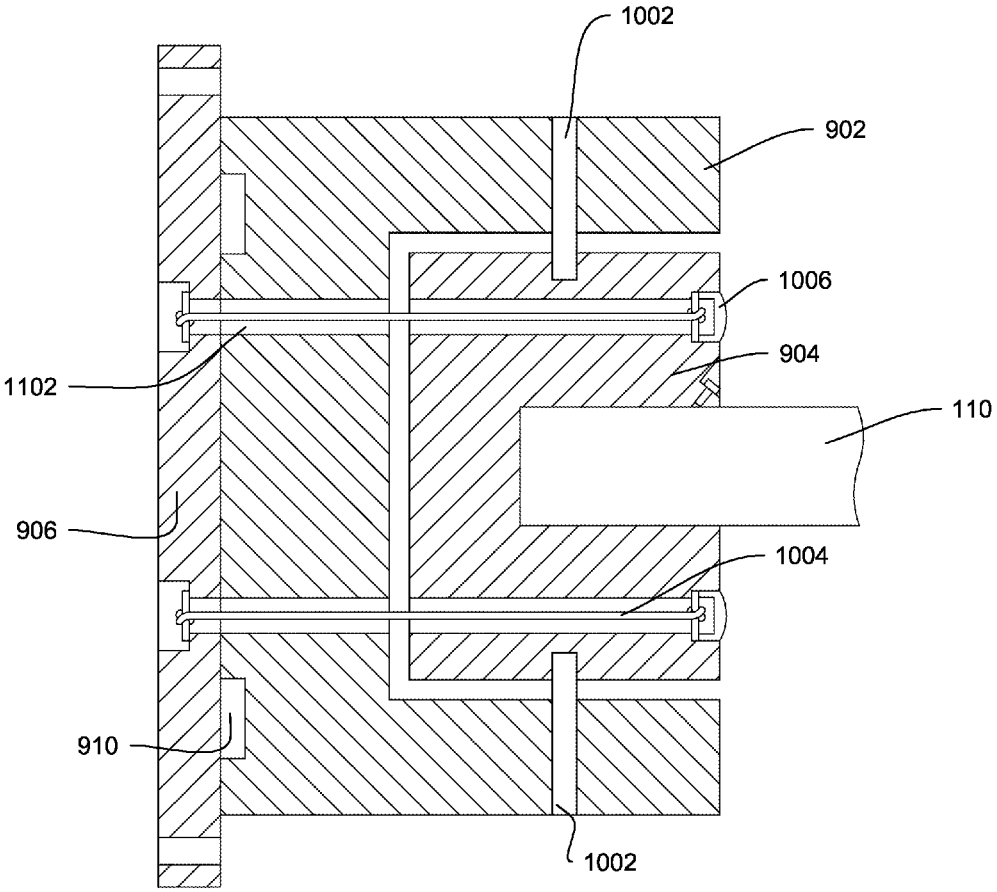
FIG. 11 provides a cross-section side view of a second variation of a dock line management device demonstrating exemplary components.

FIG. 11 further illustrates an exemplary variation of the second example. This figure illustrates a cross section of a line arm assembly 800, including a chamber 902, a revolving element 904, an arm 110, and a resilient element 1002. In this example, two springs 1002 are illustrated. However, any number of springs 1002 may be used to accomplish the same end (e.g., return of the arm to a resting position upon release of a force on the arm).

In this variation, a revolving element 904 is assembled with a chamber 902. Pins 1002, in this example, two pins 1002, hold the revolving element 904 to the chamber 902. The revolving element 904 is capable of revolving on the pins 1002. The pins 1002 may be separate elements, as shown in FIG. 11. Additionally or alternatively, the pins 1002 may be continuous with either the chamber 902 or the revolving element 904. The two pins 1002 may also be replaced by one pin 1002, e.g., one pin 1002 that would pass through the revolving element 904 in any effective manner, and come out the other side.

In this variation, a channel 1102 passes through both the chamber 902 and the revolving element 904. The channel 1102 provides passage for a resilient element 1004. The resilient element 1004 is secured at a location on the chamber 902 (or in this example, the backboard 906), passes through the channel 1102 (e.g., through the chamber 902 and the revolving element 904) and is secured again at a location on the revolving element 904. In this example, a cap 1006 is also show. The cap 1006 may act as a securing element or it may act merely to cover the attachment point, or otherwise.

Figure 12:
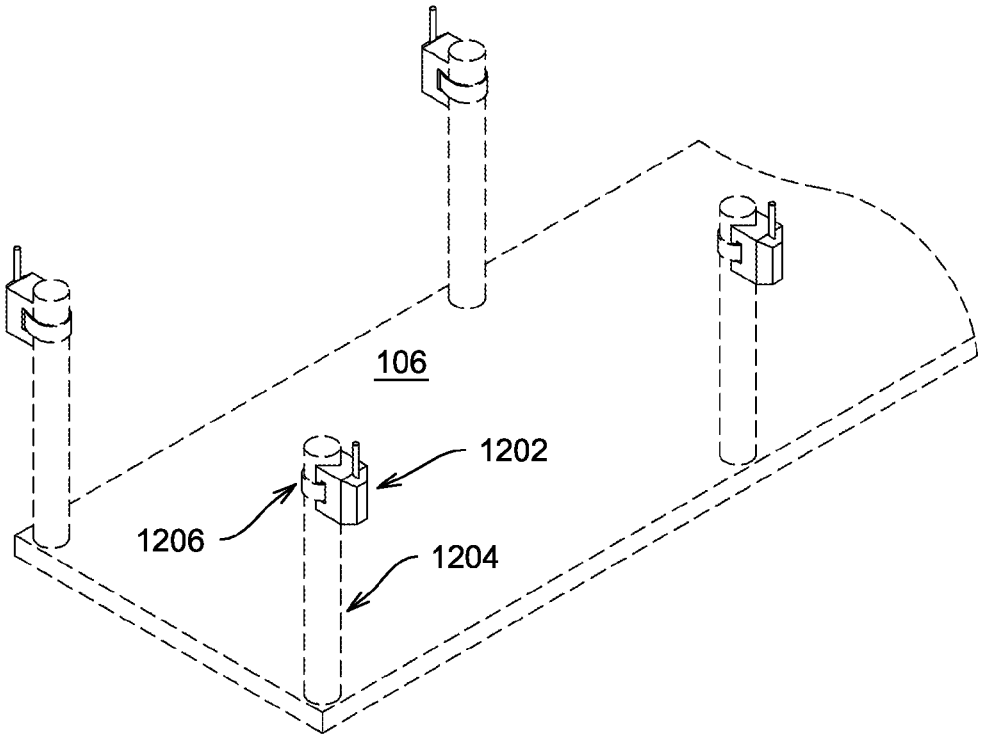
FIG. 12 provides a perspective view of a third variation of a dock line management device in an environment.
Figure 13:
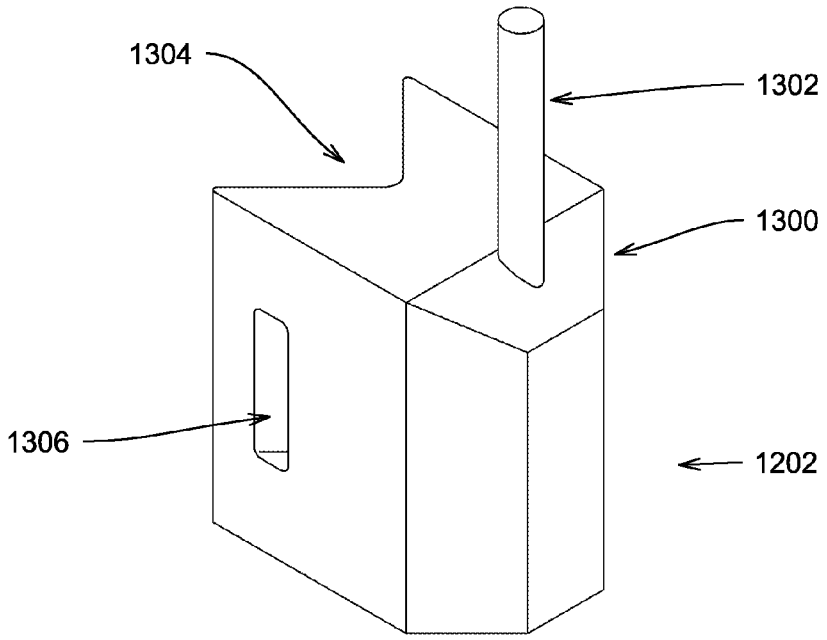
FIG. 13 provides a perspective view of a third variation of a dock line management device.
Figure 14:
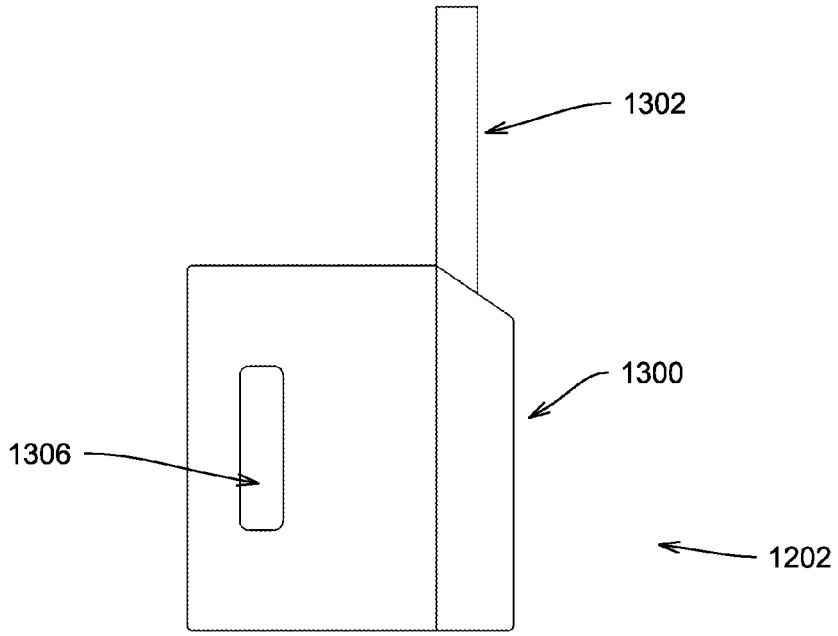
FIG. 14 provides a first side view of a third variation of a dock line management device.
Figure 15:
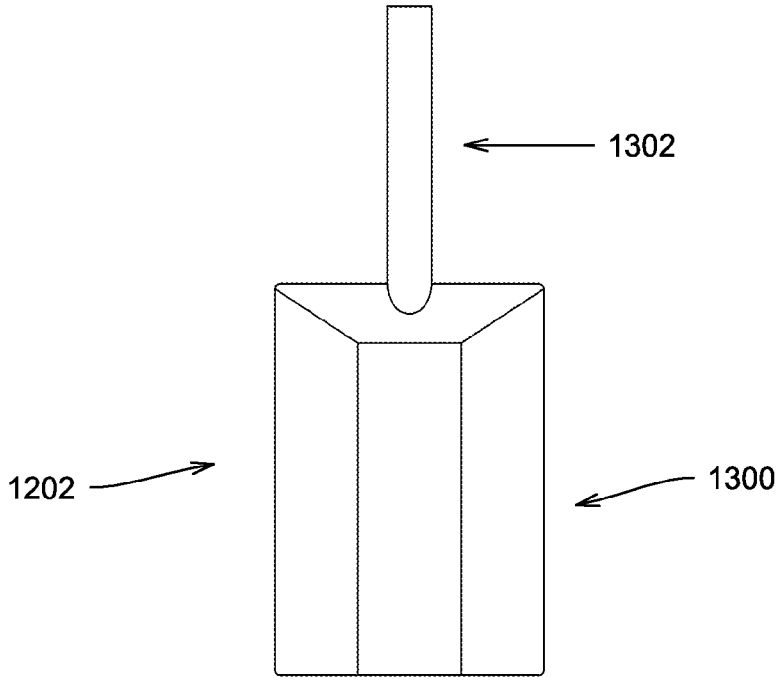
FIG. 15 provides a second side view of a third variation of a dock line management device.
Figure 16:
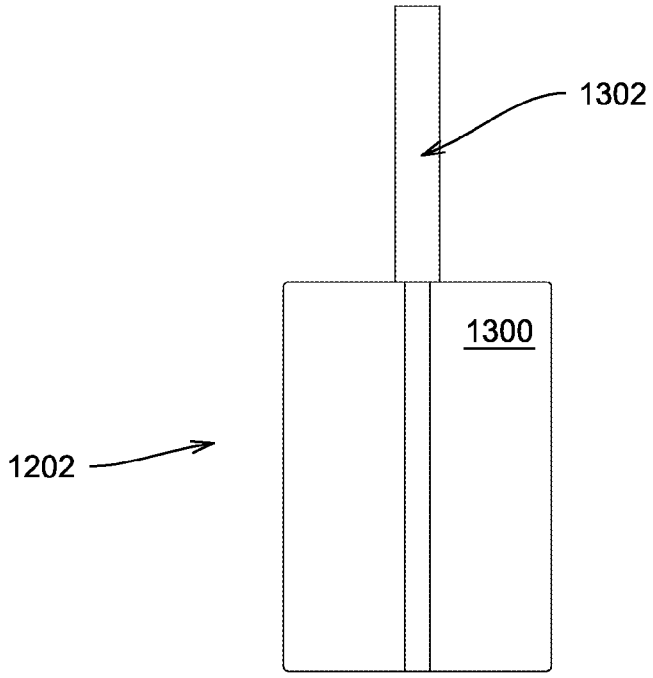
FIG. 16 provides a third side view of a third variation of a dock line management device.
Figure 17:
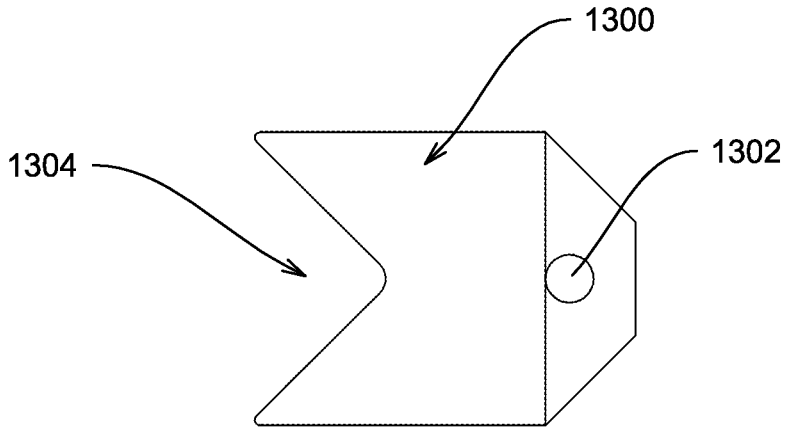
FIG. 17 is a top view of a third variation of a dock line management device.
Figure 18:
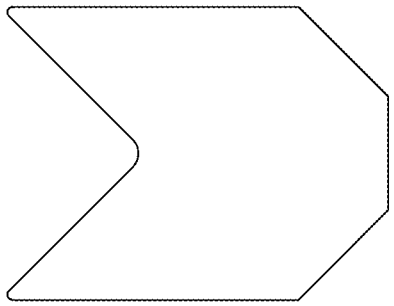
FIG. 18 is a bottom view of a third variation of a dock line management device.

FIGS. 12-18 disclose a third variation of a dockline management device. FIG. 12 illustrates a dockline management device in an environment of a dock 106. In this example, the dockline management device 1202 is illustrated attached to a dock post 1204 by means of a strap 1206. Turning to FIG. 13, a dock line management device 1202 may include a body 1300, a line catch 1302. The body 1300 may define a recess

1304 for receiving a post, e.g., a dock post, a tree, or other objects associated with a docking location or a boat. The body 1300 may additionally or alternatively define a recess 1306 which may be dimensioned to receive a belt, cord, or other attachment device.

In operation, the dockline management device 1202 may be attached to, for example, a dock post and may serve as a catch for a dock line. The dockline management device 1202 may be mobile, and therefore capable of carrying to various locations, for example, remote locations, for securing a boat to a docking location—whether traditional (a boat dock) or not traditional (e.g., a buoy, a tree, or other object located in a waterway accessible to boats).

While various embodiments of the invention have been described, it will be apparent to those of ordinary skill in the art that many more embodiments and implementations are possible that are within the scope of the invention.

The invention claimed is:

1. A boat docking device comprising:

a chamber;

a revolving element positioned within the chamber;

an arm attached to the revolving element;

the arm movable between a first position and a second position;

a resilient element attached inside of the revolving element, the resilient element capable of returning the arm from the second position to the first position;

wherein the chamber has a first end and a second end; the second end of the chamber terminates at an end of a travelling surface formed at an angle with a plane extending parallel to a longitudinal axis of the chamber, the travelling surface having a lowest point and a highest point; and wherein the revolving element comprises a traveler;

wherein the traveler is capable of movement along the travelling surface from the lowest point toward the highest point; and wherein movement of the traveler along the travelling surface from the highest point to the lowest point extends the resilient element.

2. A boat line management device, the device comprising:

a chamber having a recess formed therein for receiving a revolving element;

the revolving element positioned within the chamber;

the revolving element assembled with an arm;

the arm comprising a line securing element;

a channel passing through the chamber and the revolving element;

a resilient element passing through the channel; and the resilient element capable of facilitating return of the revolving element to a resting position.

* * * * *